US007866905B2

(12) United States Patent
Mihara et al.

(10) Patent No.: US 7,866,905 B2
(45) Date of Patent: Jan. 11, 2011

(54) THRUST-OUT TYPE CONTAINER FOR A ROD-SHAPED ARTICLE SUCH AS A LIPSTICK

(75) Inventors: Yutaka Mihara, Tokyo (JP); Yoshinobu Abe, Tokyo (JP); Kenichi Hiyama, Tokyo (JP)

(73) Assignee: Hidan Co., Ltd., Tokyo (JP)

( * ) Notice: Subject to any disclaimer, the term of this patent is extended or adjusted under 35 U.S.C. 154(b) by 867 days.

(21) Appl. No.: 11/808,222

(22) Filed: Jun. 7, 2007

(65) Prior Publication Data

US 2008/0041747 A1 Feb. 21, 2008

(30) Foreign Application Priority Data

Jun. 12, 2006 (JP) ..... 2006-162488

(51) Int. Cl.
*B43K 21/08* (2006.01)

(52) U.S. Cl. ..... 401/78; 401/75

(58) Field of Classification Search ..... 401/65, 401/75, 77, 78, 86, 194; 206/385; 220/690, 220/837–841
See application file for complete search history.

(56) References Cited

U.S. PATENT DOCUMENTS 5,979,691 A * 11/1999 Von Holdt ..... 220/266
6,588,959 B1 * 7/2003 Kuo ..... 401/108
6,623,199 B2 * 9/2003 Naramoto et al. ..... 401/98
6,682,243 B2 * 1/2004 Iwamoto et al. ..... 401/75

FOREIGN PATENT DOCUMENTS

| | | | |
|---|---|---|---|
| GB | 2245544 | * | 1/1992 |
| JP | 2003-164328 | | 6/2003 |
| JP | 2004-33294 | | 2/2004 |
| WO | WO 93/16615 | * | 9/1993 |

* cited by examiner

*Primary Examiner*—David J Walczak
(74) *Attorney, Agent, or Firm*—Clark & Brody

(57) ABSTRACT

A thrust-out type container for a rod-like article such as a lipstick comprises, in the order from the outside to the inside as viewed in a diametric direction of the container, an outer cylinder, an inner cylinder and a carrier. The carrier serves to support the rod-like article attached thereto. A control cylinder integrated with the inner cylinder lies outside the outer cylinder. An intermediate cylinder is interposed between the outer cylinder and the control cylinder. The intermediate cylinder comprises an upper portion extending upward beyond an upper end of the control cylinder and a lower portion extending into the control cylinder. A coupling member serving to couple the inner cylinder and the intermediate cylinder to each other is snap-engaged with the lower portion of the intermediate cylinder.

3 Claims, 4 Drawing Sheets

THRUST-OUT TYPE CONTAINER FOR A ROD-SHAPED ARTICLE SUCH AS A LIPSTICK

BACKGROUND OF THE INVENTION

The present invention relates generally to a thrust-out type container for a rod-like article such as a lipstick.

So-called thrust-out type container for a lipstick or the like is conventionally available, which is generally constructed in a manner that a carrier contained within the inner cylinder and provided with the lipstick moves upward or downward as an inner cylinder is rotated with one hand while an outer cylinder is immobilized with the other hand wherein the carrier can move upward sufficiently to expose the lipstick from a top opening of the outer cylinder. For an actual rotation of the inner cylinder, a control cylinder provided so as to surround the outer cylinder is rotated with fingers. This control cylinder is coupled to the inner cylinder via a coupling member.

Such a thrust-out type container is disclosed, for example, in Japanese Unexamined Patent Application Publication No. 2003-164328A. In the case of the thrust-type container disclosed in this document, an intermediate cylinder is interposed between an outer cylinder and a control cylinder and this intermediate cylinder has its inner peripheral surface engaged with an outer peripheral surface of an inner cylinder so as to be rotated together with the inner cylinder. The upper portion of the intermediate cylinder extends upward beyond the upper end of the control cylinder and adapted to slide along the inner peripheral surface of a cap in close contact with the this inner peripheral surface as the cap is put on the container's body. The intermediate cylinder is fixed to the control cylinder by means of welding or adhesive in order to protect the intermediate cylinder against unintentionally falling off from the control cylinder due to repeated opening and closing the cap.

A thrust-out type container disclosed in Japanese Unexamined Patent Application Publication No. 2004-33294A comprises a circular outer cylinder and a square control cylinder. An intermediate cylinder interposed between the outer cylinder and the control cylinder consists of a circular cylindrical portion circumscribing the outer cylinder and a square cylindrical portion circumscribing the control cylinder. A cap of the thrust-out type container has its inner peripheral surface adapted to be partially brought in close contact with the outer peripheral surface of the circular cylindrical portion of the intermediate cylinder as the cap is put on a body of the container. The intermediate cylinder serves to fill a gap defined between the circular outer cylinder and the square control cylinder from above the thrust-out container and is bonded to the inner peripheral surface of the control cylinder by means of welding or adhesive.

In the case of the thrust-out type container of prior art as has been exemplarily described above, the intermediate cylinder is fixed to the control cylinder using an adhesive or a welding technique. A fixing operation by the welding technique for this purpose usually requires a time at least several seconds and a fixing operation using the adhesive usually requires much more time. In view of this problem, it is a principal object of the present invention to improve the conventional thrust-out type container so that a working time required for incorporation of the intermediate cylinder into the thrust-out container.

SUMMARY OF THE INVENTION

The object set forth above is achieved, according to the present invention, by an improvement in a rod-like article container of thrust-out type having a vertical direction and a diametric direction orthogonal to the vertical direction and basically comprising a body adapted to thrust-out the rod-like article through an opening formed at a top thereof as viewed in the vertical direction and a cylindrical cap configured so as to be detachably put on the body and to close the opening, the body including an outer cylinder, an inner cylinder and a carrier for rod-like article all sharing a center axis extending in the vertical direction and respectively allocated in such order from the outside to the inside, wherein a control cylinder integrated with the inner cylinder and provided around the outer cylinder may be manipulated with the outer cylinder held immobilized to rotate the inner cylinder in the circumferential direction around the center axis to guide the carrier for the rod-like article contained within the inner cylinder by the inner cylinder in the vertical direction so as to thrust out the rod-like article from said opening.

The improvement according to the present invention is in that there is provided between the outer cylinder and the control cylinder as viewed in the diametric direction an intermediate cylinder having a peripheral wall surrounding the outer cylinder, wherein the peripheral wall of the intermediate cylinder has its upper portion formed so as to extend upward beyond the upper end of the control cylinder into the interior of the cap closing the opening and to be kept in close contact with the inner peripheral surface of the cap, on one hand, the peripheral wall of the intermediate cylinder has its lower portion formed so as to extend into the interior of the control cylinder and to be kept in close contact with the inner peripheral surface, on the other hand, and the lower portion of the peripheral wall being snap-engaged with a coupling member adapted to couple the inner cylinder and the intermediate cylinder to each other so that these two cylinders can be integrally rotated but the intermediate cylinder can not move in the vertical direction.

According to one preferred embodiment of the invention, the lower portion of the peripheral wall defining the intermediate cylinder is formed with a plurality of through-holes used for the snap-engagement while the coupling member is formed with hooks extending along the inside of the intermediate cylinder and adapted to be engaged with the through-holes from the inside.

According to another preferred embodiment of the invention, the coupling member is formed with a plurality of arms extending upward in the vertical direction of the thrust-type container and adapted to be elastically deformable in the diametric direction and respective upper ends of the arms are formed with the hooks.

According to still another preferred embodiment of the invention, the control cylinder and the intermediate cylinder are polygonal cylinders configured so as to be engaged with each other in the vertical direction with the control cylinder outside and the intermediate cylinder substantially circumscribes the circular outer cylinder, and the elastic arms of the coupling member are formed in spaces defined between the intermediate cylinder and the outer cylinder in the vicinity of respective corners in the polygon.

According to yet another preferred embodiment of the invention, the lower portion of the peripheral wall defining the intermediate cylinder is formed with notches each extending up from the lower end of the peripheral wall toward the upper portion and having a width in the circumferential direction larger in the upper portion than in the lower portion, the coupling member is formed with elastic arms adapted to be elastically deformable the diametric direction and to be snap-engaged with the notches from the inside or the outside as viewed in the diametric direction, and the lower portion of the peripheral wall has a substantially same thickness as the thickness of the elastic arms.

The thrust-out type container for rod-like article according to the present invention enables the container to be easily assembled and enables a working time required for assembling to be efficiently reduced.

According to the embodiment of the invention wherein the lower portion of the peripheral wall defining the intermediate cylinder is formed with the through-holes while the coupling member is formed with hooks adapted to be snap-engaged with these through-holes, the coupling member may be inserted into the inner cylinder to snap-engage the intermediate cylinder with the coupling member.

According to the embodiment of the invention wherein the coupling member is formed with the elastic arms which are, in turn, formed at the upper ends thereof with the hooks, the arms are elastically deformed inward as viewed in the diametric direction of the intermediate cylinder as the arms are moved into the intermediate cylinder, resulting in that the hooks can be easily snap-engaged with the intermediate cylinder.

According to the embodiment of the invention wherein both the control cylinder and the intermediate cylinder are polygonal and the intermediate cylinder is snap-engaged with the coupling member in the vicinity of corners of the polygonal, the elastic arms of the coupling member can be located in the spaces respectively defined between the corners of the polygonal intermediate cylinder and the circular outer cylinder without an inconvenience that the presence of the elastic arms might increase the outer dimension of the thrust-out type container.

According to the embodiment of the invention wherein the arms of the coupling member are snap-engaged with the notches of the intermediate cylinder and each of these arms has a substantially same thickness as the thickness of the peripheral wall defining the intermediate cylinder, there is no inconvenience that the presence of the arms might increase the outer dimension of the thrust-out type container.

DETAILED DESCRIPTION OF THE PREFERRED EMBODIMENTS

Details of a thrust-out type container for the rod-like article according to the present invention will be more fully understood from the description given hereunder with reference to the accompanying drawings.

Figure 1:
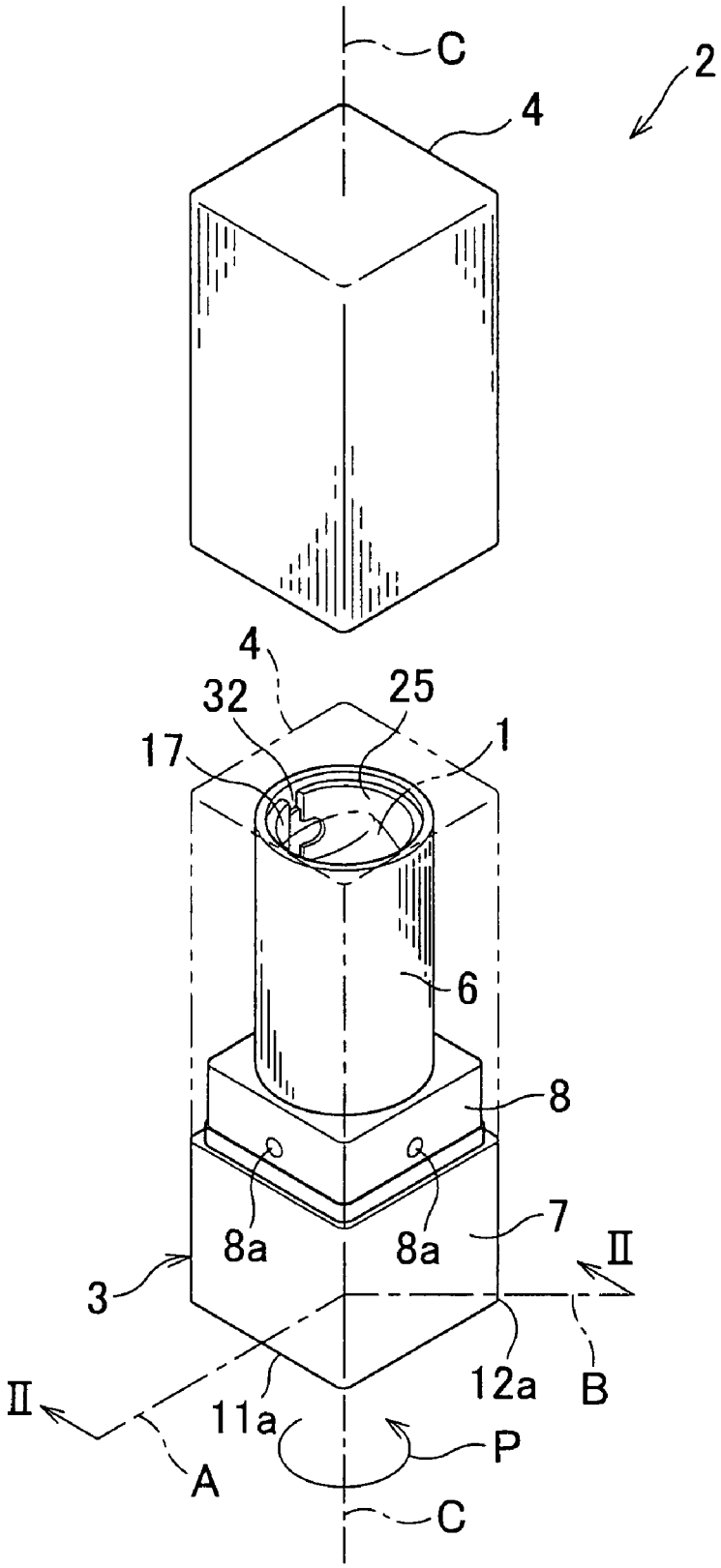
FIG. 1 is a perspective view of a thrust-type container.

FIG. 1 is a perspective view showing a thrust-out type container 2 for a lipstick 1 as an example of the rod-like article. The lipstick container 2 basically comprises a body 3 containing therein the lipstick 1 in a manner that the lipstick 1 may be thrust-out whenever it is desired and a cap 4 adapted to be detachably put on the body 3. Referring to FIG. 1, the body 3 and the cap 4 separated from each other are indicated by solid lines while the cap 4 put on the body 3 is indicated by imaginary lines. The body 3 comprises a circular outer cylinder 6, a square control cylinder 7 having a square cross-section and an intermediate cylinder 8 interposed between these two cylinders 6, 7 integrally with the control cylinder 7 as will be described later. In an operation of the lipstick container 2, the lipstick 1 is moved upward until it is exposed outward from the lipstick container 2 as the control cylinder 7 is counterclockwise rotated as indicated by an arrow P with one hand while the outer cylinder 6 is immobilized with the other hand. The lipstick 1 is moved downward to the position shown by FIG. 1 as the control cylinder 7 is rotated in a direction opposite to the direction P.

Figure 2:
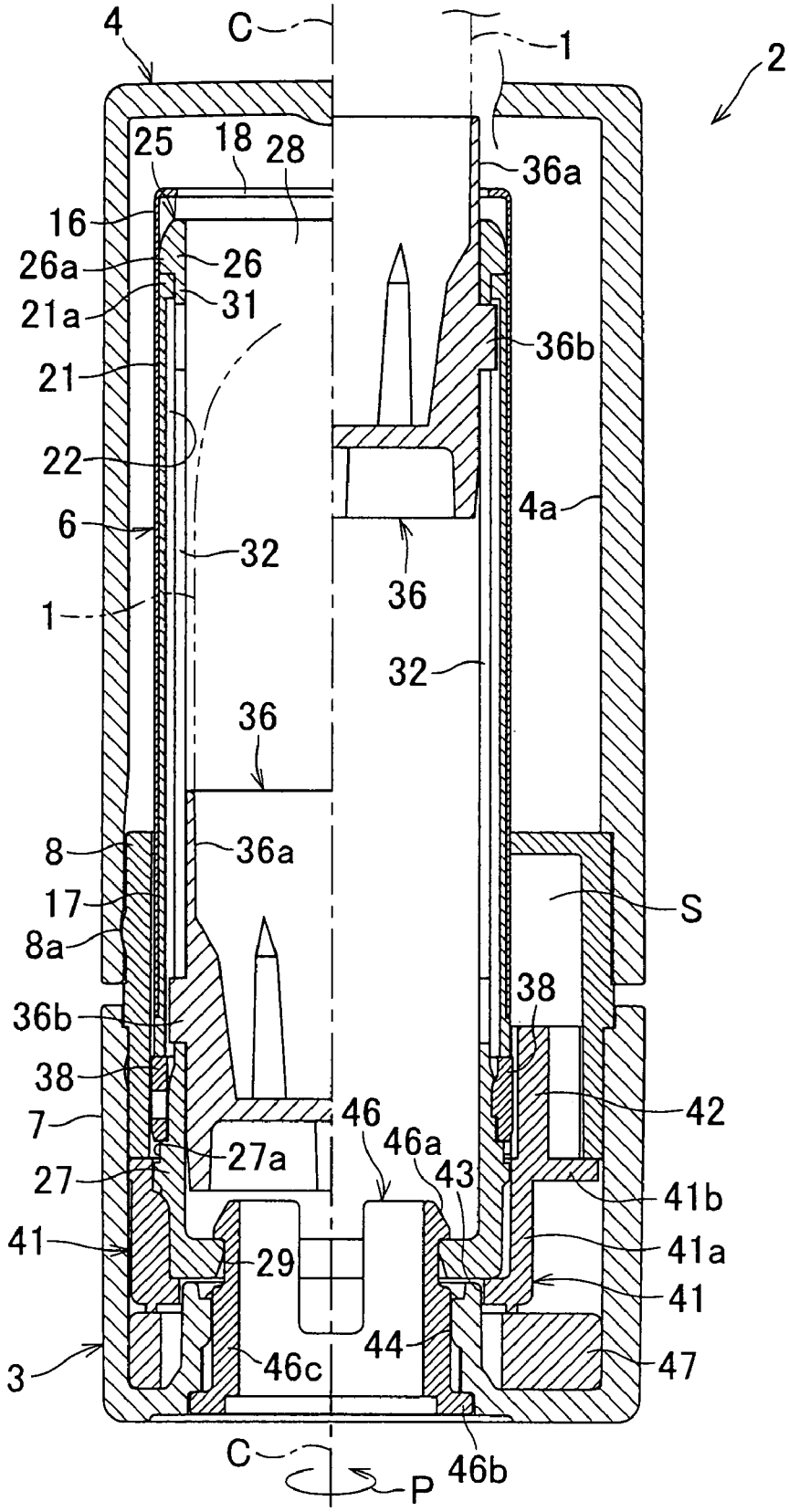
FIG. 2 is a sectional view taken along the line II-II in FIG. 1.

FIG. 2 is a sectional view taken along the line II-II in FIG. 1, the line II-II comprising a line segment A extending from a longitudinal center line C-C of the lipstick container 2 in a direction perpendicular to one of the sides defining a bottom of the control cylinder 7 and a line segment B extending from the center line C-C through one of the corners of said bottom. Of FIG. 2, the left side with respect to the center line C-C shows the sectional view taken along the line segment A and the right side with the center line C-C shows the sectional view taken along the line segment B. The cap 4 is shown herein as put on the body 3.

Referring to FIG. 2, the outer cylinder 6 is a circular cylinder being open both at upper and lower ends 16, 17 thereof, wherein the upper end 16 has an opening 18 and the lower end 17 received within the intermediate cylinder 8. The outer cylinder 6 is further provided on its inner peripheral surface with a threaded cylinder 21 fixed thereto, which is, in turn, provided on its inner peripheral surface with a pair of helical grooves 22 diametrically opposed to each other. The threaded cylinder 21 contains therein an inner cylinder 25 adapted to be rotatable circumferentially of the threaded cylinder 21.

The inner cylinder 25 has upper and lower ends 26, 27 and a peripheral wall 31 wherein an opening 28 of the upper end 26 has a substantially same diameter as the opening 18 of the outer cylinder 6 has. The peripheral wall 31 is formed with a pair of notches 32 (See FIG. 1) extending from the opening 28 to the proximity of the lower end 27 and opposed to each other diametrically of the inner cylinder 25. The inner cylinder 25 contains therein a carrier 36 serving to support the lipstick 1 from its lower end.

The carrier 36 comprises a cylindrical main portion **36*a* and a pair of prominent portions 36*b* horizontally extending from the main portion 36*a* diametrically outward, i.e., in mutually opposite directions. Each of these prominent portions 36*b* extends through the associated notch 32 of the inner cylinder 25 so as to be slidable in vertical direction and, at the same time, so to be slidable along the associated helical groove 22**.

At a lower part of the body 3, an annular spring member 38 is mounted around the lower end 27 of the inner cylinder 25 in a manner that the spring member 38 can not be rotated circumferentially of the inner cylinder 25. The spring member 38 is supported by a lower flange **27*a* of the inner cylinder 25 from below and supports the threaded cylinder 21 from below. An upper end 21*a* of the threaded cylinder 21 is biased under the effect of the spring member 38 to bear against an upper flange 26*a* of the inner cylinder 25 from below. A coupling member 41 comprising a cylindrical peripheral wall 41***a* and an upper flange 41*b* is mounted around the lower end 27 of the inner cylinder 25 in a manner that the coupling member 41 can not be rotated circumferentially of the lower end 27. More specifically, the coupling member 41 is mounted around the lower end 27 in a particular fashion such that convexities 25*a* and concavities 25*b* (See FIG. 3) formed on the outer peripheral surface of the inner cylinder 25 alternately in the circumferential direction are respectively engaged with concavities 41*d* and convexities 41*e* (See FIG. 3) formed on the inner peripheral surface of the coupling member 41 alternately in the circumferential direction. The upper flange 41*b* of the coupling member 41 is formed with elastic arms 42 extending upward and these arms 42 are formed at respective distal ends with hooks 51 adapted to be engaged with the intermediate cylinder 8 (See FIG. 3). The control cylinder 7 is engaged with the intermediate cylinder 8 from the outside. These inner cylinder 25, coupling member 41 and control cylinder 7 respectively have lower openings 29, 43, 44 sharing the longitudinal center line C-C. A cylindrical locking member 46 is inserted into these lower openings 29, 43, 44 through the bottom of the control cylinder 7.

The locking member 46 includes upper and lower flanges 46*a*, 46*b* serving to hold the periphery of the lower opening 29 and the periphery of the lower opening 43 from above and below, respectively, in the vertical direction as viewed in FIG. 2. Simultaneously, concavities 46*e* and convexities 46*f* (See FIG. 3) formed on the outer surface of a peripheral wall 46*c* of the locking member 46 intermittently in the circumferential direction are respectively engaged with convexities 56*a* and concavities 56*b* of the control cylinder 7 with a result that the control cylinder 7, the intermediate cylinder 8, the coupling member 41, the inner cylinder 25 and the carrier 36 are integrated together so as to be rotatable concurrently one with another. It should be noted that a metallic balancer 47 used to adjust a weight of the container 1 is incorporated between the inner surface of the bottom of the control cylinder 7 and the outer surface of the bottom of the coupling member 41.

In operation of the container 2 constructed having been described above with reference to FIG. 2, after the cap 4 has been taken off from the body 3, the inner cylinder 25 within the threaded cylinder 21 rotates in the direction P as the control cylinder 7 is rotated around the center line C-C in the direction P with one hand while the outer cylinder 6 is immobilized with the other hand. The rotation of the inner cylinder 25 causes the carrier 36 to move from its position as seen on the left side with respect to the center line C-C in FIG. 2 to its position as seen on the right side with respect to the center line C-C in FIG. 2. More specifically, the prominent portions 36*b* of the carrier 36 move upward along the helical grooves 22 so that the lipstick 1 supported by the carrier 36 is moved upward within the inner cylinder 25 until it is exposed outward from the openings 28, 18.

Figure 3:
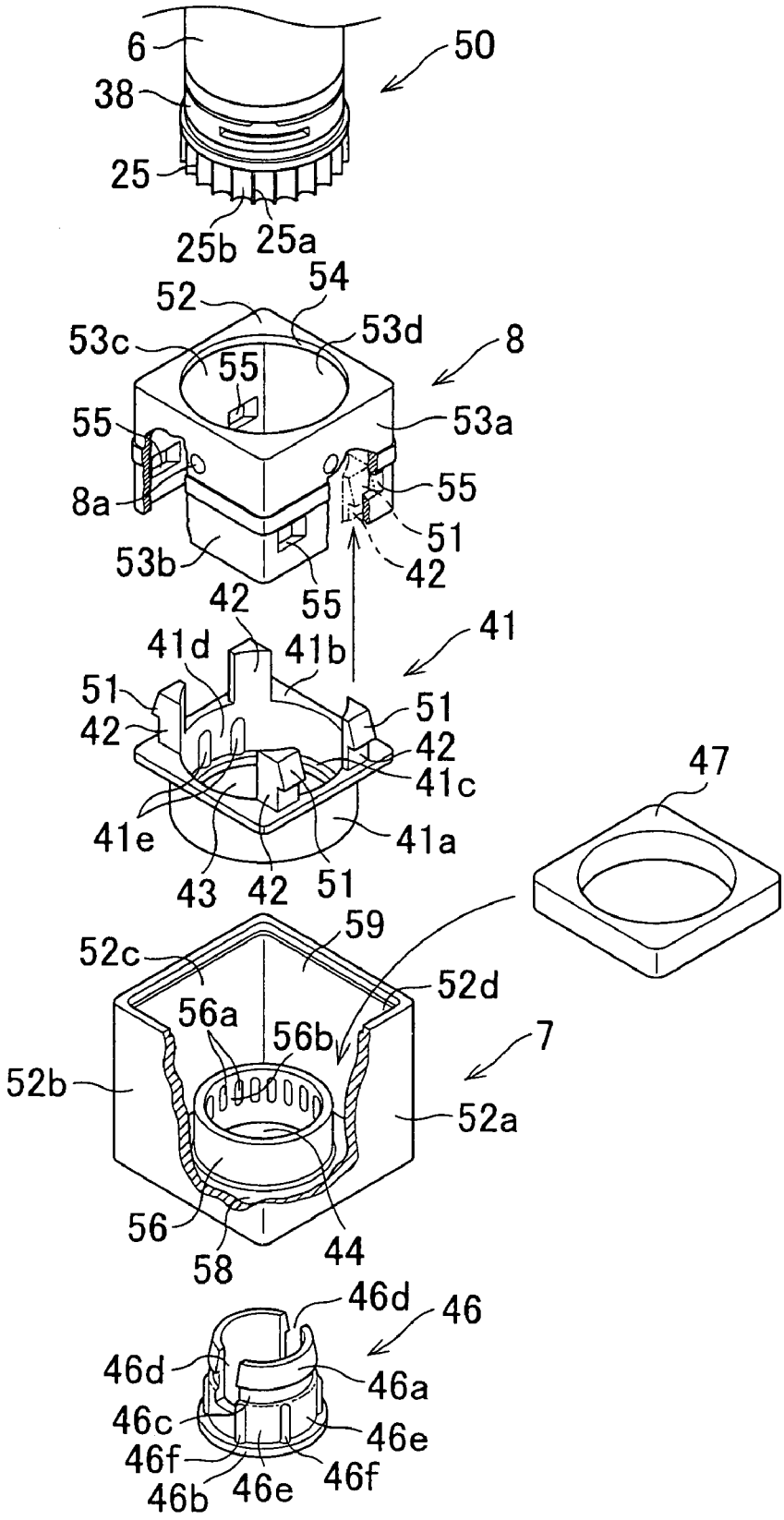
FIG. 3 is a partially cutaway exploded perspective view showing the thrust-out type container before it is assembled.

FIG. 3 is a partially cutaway exploded perspective view showing the container 1 before it is assembled. A subassembly 50 comprising the outer cylinder 6, the inner cylinder 25, the carrier 36 (see FIG. 2) and the spring member 38 is shown in the uppermost region of FIG. 3 as partially broken away. Below the subassembly 50, FIG. 3 shows the intermediate cylinder 8, the coupling member 41, the control cylinder 7 and locking member 46 to be assembled together. The intermediate cylinder 8 is a square cylinder having a square cross-section and defined by a top face 52 and four peripheral walls 53*a*, 53*b*, 53*c*, 53*d*. The top face 52 is formed with a circular opening 54 while each of the peripheral walls 53*a* and 53*c* is formed at its lower portion with a pair of through-holes 55. The subassembly 50 can be inserted into the circular opening 54 from above as viewed in FIG. 3 so that a lower end portion of the subassembly 50 may be received within the cylindrical peripheral wall 41*a* of the coupling member 41. The peripheral wall 41*a* has the concavities 41*d* and the convexities 41*e* formed on the inner peripheral surface thereof alternately in the circumferential direction. Of these concavities 41*d* and convexities 41*e*, the convexities 41*e* are adapted to be engaged with the concavities 25*b* of the inner cylinder 25 received within the peripheral wall 41*a*. The peripheral wall 41*a* is formed at its bottom with a lower flange 41*c* serving to support the subassembly 50 from below. The lower flange 41*c* defines the lower opening 43. The upper flange 41*b* is dimensioned and shaped substantially in conformity with the top face 52 of the intermediate cylinder 8. In the vicinity of the respective corners, the upper flange 41*b* is formed with the elastic arms 42 extending up toward the intermediate cylinder 8.

The control cylinder 7 is also a square cylinder having a square cross-section and defined by peripheral walls 52*a*, 52*b*, 52*c*, 52*d* and a bottom 58. The peripheral walls 52*a* through 52*d* define together a square upper opening 59 while the bottom 58 is centrally formed with the lower opening 44. A circular cylindrical peripheral wall 56 extends upward from the periphery of the lower opening 44 and this peripheral wall 56 is formed along its inner peripheral surface with the convexities 56*a* and the concavities 56*b* alternately in the circumferential direction. The upper opening 59 is dimensioned just to receive the coupling member 41 and the intermediate cylinder 8 inserted through this opening 59. The intermediate cylinder 8 having been inserted through the opening 59 is kept in close contact with the inner peripheral surface of the control cylinder 7 while the coupling member 41 having been inserted through the opening 59 has its bottom bearing against the balancer 47 contained within the control cylinder 7 and is stopped thereby.

The locking member 46 is adapted to be elastically deformed inward in its radial direction, i.e., in its diameter-reducing direction as the locking member 46 is inserted through the lower opening 44 of the control cylinder 7. In order to facilitate such deformation, the peripheral wall 46*c* is formed with a pair of notches 46*d* extending downward from an upper flange 46*a*. The peripheral wall 46*c* is further formed with the concavities 46*e* and the convexities 46*f* alternately in the circumferential direction.

Referring to FIG. 3, the respective arms 42 of the coupling member 41 are pressed against the inner peripheral surface of the intermediate cylinder 8 and elastically deformed inwardly of the intermediate cylinder 8 as the coupling member 41 is inserted into the intermediate cylinder 8. Further insertion of the coupling member 41 causes the respective hooks 51 formed on the distal ends of the respective arms 42 to be engaged with the associated through-holes 55 of the intermediate cylinder 8. In this manner, the coupling member 41 is snap-engaged with the intermediate cylinder 8. Virtually at the same time, the upper flange 41*b* of the coupling member 41 bears against the lower end of the intermediate cylinder 8 and thereupon the coupling member is stopped. The intermediate cylinder 8 and the coupling member 41 engaged and integrated with each other in this manner can neither rotate relatively to each other nor move relatively to each other in the vertical direction. Insertion of the subassembly 50 through the circular opening 54 into the intermediate cylinder 8 from the above as viewed in FIG. 3 causes the convexities 25*a* and the concavities 25*b* of the inner cylinder 25 to be respectively engaged with the concavities 41*d* and the convexities 41*e* of the coupling member 41. Then, the control cylinder 7 is tightly put on the intermediate cylinder 8 from below as viewed in FIG. 3 so that the inner peripheral surface of the control cylinder 7 may be kept in close contact with the outer peripheral surface of the intermediate cylinder 8 and the lower end of the coupling member 41 may bear against the balancer 47. Subsequently the locking member 46 is inserted through the lower opening 44 into the control cylinder 7 from below as viewed in FIG. 3 until the upper flange 46*a* of the locking member 46 passes through the lower opening of the inner cylinder 25 and thereby assembly of the body 3 constituting the container 2 is completed as shown in FIG. 2. It should be understood that the lipstick 1 may be set on the carrier 36 in an appropriate one of the assembling steps as have been described above.

In the container 2 constructed in such a manner, an upper portion of the intermediate cylinder 8 extending upward beyond the upper end of the control cylinder 7 is formed on the outer peripheral surface with raised portions 8*a* (See FIG. 1) adapted to be snap-engaged with the inner peripheral surface of the cap 4. The cap 4 is formed at respective corners with stoppers 4*a* (See FIG. 2) adapted to bear against the associated corners of the intermediate cylinder 8 as the cap 4 is put on the body 3. In the container 2, the coupling member 41 interposed between the inner cylinder 25 and the intermediate cylinder 8 for the purpose of permitting these two cylinders 25, 8 to be rotated integrally is coupled to the inner cylinder 25 through engagement between the respective peripheral walls and coupled to the intermediate cylinder 8 through the snap-engagement established via the elastic arms 42. Coupling in such a fashion advantageously simplifies and accelerates an operation of assembling compared to the case in which the container is assembled by use of welding and/or adhesive. Specifically, the time required for snap-engagement between the coupling member 41 and the intermediate cylinder 8 is 1 second or less. While the elastic arms 42 may be formed on the upper flange 41*b* of the coupling member 41 at any locations, each of these elastic arms 42 is preferably present in a space S (See FIG. 2) defined between the circular outer cylinder 6 and each of the corners of the square intermediate cylinder 8, in order to avoid an increase of the outer dimension of the container 2 because of the presence of the elastic arms 47.

Figure 4:
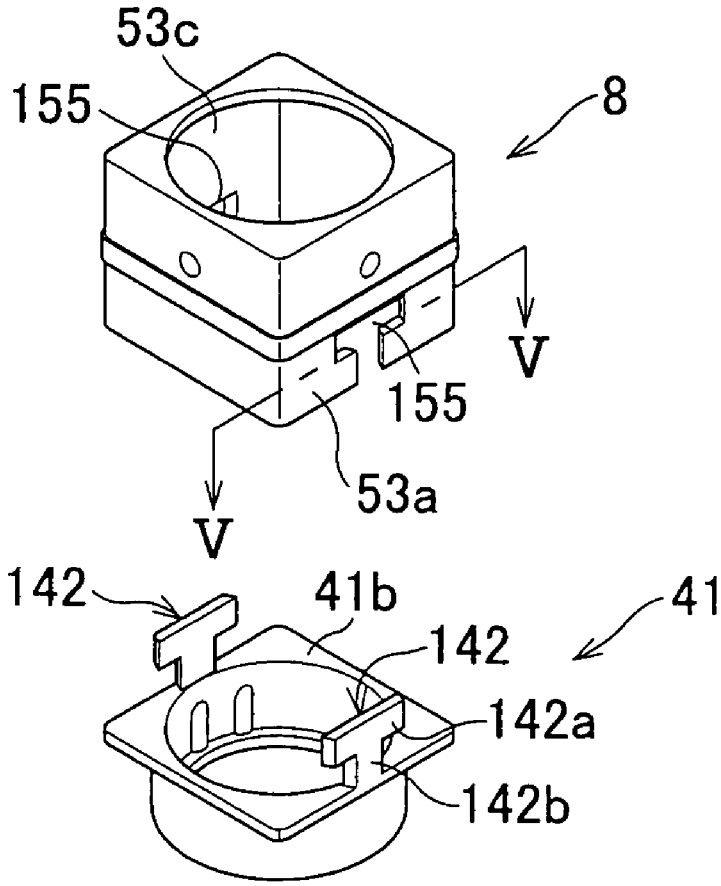
FIG. 4 is a perspective view showing an intermediate cylinder and a coupling member according to one embodiment of the invention.
Figure 5:
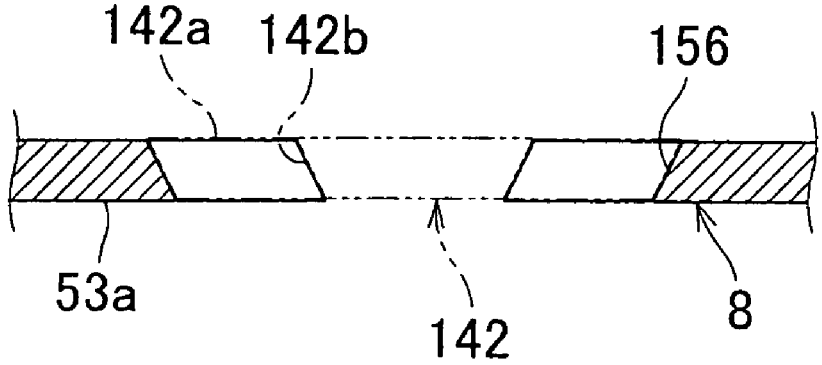
FIG. 5 is a sectional view taken along the line V-V in FIG. 4.

FIG. 4 is a perspective view showing the intermediate cylinder 8 and the coupling member 41 according to one preferred embodiment of the invention and FIG. 5 is a sectional view taken along a line V-V in FIG. 4. The peripheral walls 53*a*, 53*c* of the intermediate cylinder 8 are formed with T-shaped notches 155, respectively, replacing the through-holes 55 of FIG. 3. The coupling member 41 is formed with T-shaped elastic arms 142 in conformity with the shape of the notches 155. The elastic arms 142 respectively comprise heads 142*a* and legs 142*b*. The legs 142*b* are elastically deformed inwardly of the intermediate cylinder 8 as the elastic arms 142 are guided into the intermediate cylinder 8 and partially brought into contact with the inner surface of the intermediate cylinder 8. Immediately before the upper flange 41*b* of the coupling member 41 bears against the lower end of the intermediate cylinder 8 during the step of insertion, the notches 155 and the associated elastic arms 142 have respective positions in coincidence with one another whereupon the elastically deformed arms 142 restore the initial states thereof and are engaged with the associated notches 155. In this manner, the coupling member 41 is snap-engaged with the intermediate cylinder 8. Referring to FIG. 5, the intermediate cylinder 8 is indicated by solid lines and the elastic arm 142 snap-engaged with the intermediate cylinder 8 is indicated by imaginary lines. As will be apparent from FIG. 5, the periphery 156 defining the notch 155 is slanted with respect to a thickness direction of the peripheral wall 53*a* so as to ensure that an opening area in the peripheral wall 53*a* is gradually reduced from the inner side to the outer side of the intermediate cylinder 8. In order that the elastic arms 142 can be snap-engaged with the notches 155 configured as has been described above from the inner side of the intermediate cylinder 8, both the heads 142*a* and the legs 142*b* have respective edges slanted with respect to the thickness direction thereof as illustrated. In addition, both the notches 155, and the elastic arms 142 have widths measured in the circumferential direction of the intermediate cylinder 8 larger in the respective upper portions than in the lower portions thereof. So long as the elastic arms 142 are engaged with the associated notches 155, neither relative rotation between the intermediate cylinder 8 and the coupling member 41 nor relative movement between them in the vertical direction can occur. The peripheral wall 53*a* of the intermediate cylinder 8 may have a substantially the same thickness as that of the elastic arms 142 as illustrated by FIG. 5. With the elastic arms 142 configured in this manner, even if these arms 142 are formed at any locations other than the corners on the upper flange 41*b* of the coupling member 41, the presence of the elastic arms 142 does not increase the external dimension of the container 2. The intermediate cylinder 8 and the coupling member 41 exemplarily illustrated may be replaced by a construction according to which the elastic arms 142 are snap-engaged with the intermediate cylinder 8 from the outside thereof. It is also possible to replace the square intermediate cylinder 8 and the square coupling member 41 by those having circular cross-sections, respectively, and correspondingly to replace the control cylinder 7 by the one having a circular cross-section.

The present invention advantageously permits a time required to assemble the thrust-out container for a rod-like article to be effectively reduced.

The entire discloses of Japanese Patent application No. 2006-162488 filed on Jun. 12, 2006 including specification, drawings and abstract are herein incorporated by reference in its entirety.

What is claimed is:

1. A thrust-out type container for a rod-shaped article having a vertical direction and a diametric direction orthogonal to said vertical direction, said container comprising:

a body adapted to thrust-out said rod-shaped article through an opening formed at a top thereof as viewed in said vertical direction;

a cylindrical cap to be detachably put on said body and to close said opening;

an outer cylinder, an inner cylinder and a carrier for a rod-shaped article all of which are included in said body and are sharing a center axis extending in said vertical direction and respectively allocated in such an order from the outside to the inside of said rod-shaped article container;

a control cylinder, which is a square cylinder and is integrated with said inner cylinder and provided around said outer cylinder to be manipulated with said outer cylinder held immobilized to rotate said inner cylinder in the circumferential direction around said center axis to move said carrier for said rod-shaped article contained within said inner cylinder in said vertical direction so as to thrust out said rod-shaped article from said opening; and an intermediate cylinder, which is a square cylinder and is provided between said outer cylinder and said control cylinder as viewed in said diametric direction and has a top face and four peripheral walls surrounding said outer cylinder, wherein said peripheral wall of said intermediate cylinder has an upper portion and a lower portion, wherein said upper portion is formed so as to extend upward beyond an upper end of said control cylinder into an interior of said cap closing said opening and to be kept in close contact with an inner peripheral surface of said cap and said lower portion is formed so as to extend into an interior of said control cylinder and to be kept in close contact with an inner peripheral surface of said control cylinder, and said lower portion of said peripheral wall being snap-engaged with a coupling member adapted to couple said inner cylinder and said intermediate cylinder to each other so that these two cylinders adapted to be integrally rotated but said intermediate cylinder can not move in said vertical direction, wherein a lower portion of each of a pair of said peripheral walls opposing to each other among said four peripheral walls defining said intermediate cylinder is formed with two through-holes used for said snap engagement while said coupling member having a square flange dimensioned and shaped in conformity with the top face of said intermediate cylinder is formed with four hooks extending from said square flange and along an inside of said intermediate cylinder and adapted to be engaged respectively with said through-holes formed in said peripheral walls of said intermediate cylinder from said inside.

2. The container defined by claim 1, wherein said coupling member is formed with a plurality of arms extending upward in said vertical direction of said thrust-type container and adapted to be elastically deformable in said diametric direction and respective upper ends of said arms are formed with said hooks.

3. The container defined by claim 2, wherein said control cylinder and said intermediate cylinder are polygonal cylinders configured so as to be engaged with each other in said vertical direction with said control cylinder outside and said intermediate cylinder substantially circumscribes said circular outer cylinder and wherein said elastic arms of said coupling member are formed in spaces defined between said intermediate cylinder and adapted to be engaged with said through-holes of said peripheral wall of said polygonal intermediate cylinder and said outer cylinder in the vicinity of respective corners in said polygon.

* * * * *